US009505240B2

(12) United States Patent
Muench et al.

(10) Patent No.: US 9,505,240 B2
(45) Date of Patent: Nov. 29, 2016

(54) APPARATUS FOR CONVEYING A SUBSTRATE AND SYSTEM FOR PRINTING ON A SUBSTRATE

(71) Applicant: KÖRA-PACKMAT Maschinenbau GmbH, Villingendorf (DE)

(72) Inventors: Norbert Muench, Seitingen-Oberflacht (DE); Volkmar Kiessling, Villingendorf (DE)

(73) Assignee: KÖRA-PACKMAT Maschinenbau GmbH, Villingendorf (DE)

( * ) Notice: Subject to any disclaimer, the term of this patent is extended or adjusted under 35 U.S.C. 154(b) by 0 days.

(21) Appl. No.: 14/517,106

(22) Filed: Oct. 17, 2014

(65) Prior Publication Data

US 2015/0049150 A1 Feb. 19, 2015

Related U.S. Application Data

(63) Continuation of application No. PCT/EP2013/058161, filed on Apr. 19, 2013.

(30) Foreign Application Priority Data

Apr. 20, 2012 (DE) ..... 10 2012 103 533

(51) Int. Cl.

| | |
|---|---|
| ***B65H 5/14*** | (2006.01) |
| ***B65H 5/08*** | (2006.01) |
| ***B41J 11/00*** | (2006.01) |

(52) U.S. Cl.

CPC ..... *B41J 11/007* (2013.01); *B65H 5/08* (2013.01); *B65H 5/14* (2013.01);

(Continued)

(58) Field of Classification Search

CPC ... B41J 11/005; B41J 11/0085; B41J 11/007; B41J 11/0055; B41J 11/0025; B41J 13/226; B65H 23/028; B65H 23/032; B65H 23/0032; B65H 23/26; B65H 23/28; B65H 23/18; B65H 5/08; B65H 5/085; B65H 5/12; B65H 5/14; B65H 5/224; B65H 5/305; B65H 5/308; B65H 3/16; B65H 2301/44332; B65H 2301/4473; B65H 2301/44734; B65H 2402/5154; B65H 2402/523

USPC ..... 347/104

See application file for complete search history.

(56) References Cited

U.S. PATENT DOCUMENTS 6,176,484 B1 * 1/2001 Greive ..... B41F 21/08 198/470.1

7,857,297 B2 * 12/2010 Ong ..... B65G 54/02 198/619

(Continued)

FOREIGN PATENT DOCUMENTS

| | | |
|---|---|---|
| DE | 2501963 | 11/1975 |
| EP | 1882566 | 1/2008 |

(Continued)

OTHER PUBLICATIONS

International Search Report (Including translation) for corresponding International Application No. PCT/EP2013/058161, mailed Jul. 19, 2013.

(Continued)

*Primary Examiner* — Matthew Luu
*Assistant Examiner* — Patrick King
(74) *Attorney, Agent, or Firm* — Jason H. Vick; Sheridan Ross, PC

(57) ABSTRACT

An apparatus for conveying a substrate, wherein the apparatus comprises a rail-like track section having a longitudinal extension and a moving unit, which is configured to perform a movement relative to the track section along the longitudinal extension of the track section, wherein the track section and the moving unit are configured to interact such that the movement of the moving unit is effected by magnetic interaction between the track section and the moving unit, and wherein the moving unit comprises a holding unit which is configured to assume an opened and a closed state, wherein, in the opened state, a section of the substrate can be inserted into the holding unit and, in the closed state, the section is held by the holding unit. Further, a system for printing on a substrate with a previously described apparatus is disclosed.

2 Claims, 8 Drawing Sheets

(52) U.S. Cl.
CPC ..... *B65H 2301/44331* (2013.01); *B65H 2405/55* (2013.01); *B65H 2511/20* (2013.01); *B65H 2513/40* (2013.01); *B65H 2555/132* (2013.01); *B65H 2701/1311* (2013.01); *B65H 2701/1313* (2013.01); *B65H 2801/42* (2013.01)

(56) References Cited

U.S. PATENT DOCUMENTS

| | | | | |
|---|---|---|---|---|
| 8,699,001 | B2 | 4/2014 | Aoki et al. | |
| 2005/0041851 | A1* | 2/2005 | McEvoy et al. | 382/151 |
| 2006/0066705 | A1* | 3/2006 | James et al. | 347/104 |
| 2006/0280544 | A1* | 12/2006 | Holzer et al. | 400/630 |
| 2006/0284434 | A1 | 12/2006 | Yang | |
| 2007/0296134 | A1* | 12/2007 | Horiguchi | B65G 49/064 271/3.2 |
| 2008/0022866 | A1 | 1/2008 | Frank et al. | |
| 2008/0236996 | A1 | 10/2008 | Bausenwein et al. | |
| 2009/0284575 | A1* | 11/2009 | Verhoest et al. | 347/104 |
| 2010/0186613 | A1* | 7/2010 | Kopel et al. | 101/407.1 |
| 2010/0225719 | A1* | 9/2010 | Takatsuka | 347/102 |
| 2012/0056105 | A1* | 3/2012 | Aoki | 250/491.1 |
| 2012/0064461 | A1* | 3/2012 | Aoki | 430/320 |
| 2013/0136521 | A1* | 5/2013 | Garcia et al. | 400/642 |

FOREIGN PATENT DOCUMENTS

| | | |
|---|---|---|
| EP | 1977893 | 10/2008 |
| JP | 2010-093022 | 4/2010 |
| JP | 2011-026093 | 2/2011 |
| JP | 2011-086875 | 4/2011 |

OTHER PUBLICATIONS

Written Opinion for corresponding International Application No. PCT/EP2013/058161, mailed Jul. 19, 2013.

International Preliminary Report on Patentability for corresponding International Application No. PCT/EP2013/058161, mailed Oct. 21, 2014.

* cited by examiner

APPARATUS FOR CONVEYING A SUBSTRATE AND SYSTEM FOR PRINTING ON A SUBSTRATE

CROSS REFERENCE TO RELATED APPLICATIONS

This is a Continuation application of International Application No. PCT/EP2013/058161, filed on Apr. 19, 2013 designating the U.S., which international application claims priority of the German patent application DE 10 2012 103 533.4, filed on Apr. 20, 2012, each of which are fully incorporated herein by reference in their entirety.

BACKGROUND

The present disclosure relates to an apparatus for conveying a substrate. The disclosure also relates to a system for printing on a substrate.

The conveying of substrates using automated processing or industrial manufacturing is a particular technical challenge. Part of the challenge lies in moving a substrate from one processing station to the next processing station during the manufacturing process. A processing station can be, for example, a station for punching, cutting, folding or in particular a station for printing.

It is a further challenge to convey the substrate such that it is provided to a processing station or is conveyed past a processing station in the best possible manner. At the same time, the conveying speed or the processing speed must not suffer, since this would result in a manufacturing throughput that is too low.

A further challenge is given, if the substrate has no auto stability or inherent stability, meaning it can be easily deformed and, in particular, does not have internal restoring forces to return to its original shape. Examples for such substrates are sheets of paper, thin plastics, textile materials and leather. While substrates with an inherent stability can be conveyed rather easily, substrates without an inherent stability have to be guided well in order to avoid deformation.

It is an object provide an apparatus for conveying a substrate which allows for a good guiding of a substrate at a good processing speed and which allows for conveying substrates without an inherent stability. It is a further object to provide a corresponding system for printing on a substrate using such apparatus.

SUMMARY OF THE INVENTION

According to a first aspect the object is achieved by an apparatus for conveying a substrate, wherein the apparatus comprises a rail-like track section having a longitudinal extension and comprises a moving unit which is configured to perform a movement relative to the track section along the longitudinal extension of the track section, wherein the track section and the moving unit are configured to interact such that the movement of the moving unit is effected by magnetic interaction between the track section and the moving unit, and wherein the moving unit comprises a holding unit which is configured to assume an opened and a closed state, wherein, in the opened state, a section of the substrate can be inserted into the holding unit and, in the closed state, the section is held by the holding unit.

One particular aspect is that the moving unit comprises a holding unit by which the substrate can be held, in particular in a frictionally engaged manner. Other embodiments are possible, where the substrate is held by the holding unit in a force-fit manner or a form-fit manner. The apparatus allows to convey substrates of varying lengths, in principle even of arbitrary length.

A further particular aspect is that the moving unit is moved relative to the track section caused by magnetic interaction between the track section and the moving unit. In particular this is achieved by a first magnetic field interacting with a second magnetic field, wherein the resulting force is used for a movement of the moving unit along the track section.

The functional principle of the apparatus is as follows. The moving unit is located in a first area of the track section in order to receive the substrate via the holding unit, wherein the holding unit may already be in the opened state. Then, the substrate is provided to the holding unit. The holding unit then changes from the opened state into the closed state, whereby the substrate is now held by the holding unit. The moving unit then moves along the track section, where it may pass by a processing station. In a second area of the track section, in particular in an end area, the holding unit opens and releases the substrate which is then received by a following process step or another conveying device.

On the one hand, the apparatus allows for a precise control of the moving unit. On the other hand, since the moving unit can be very lightweight, it is possible to accelerate, drive and slow down the moving unit quickly during the manufacturing process, so that a high throughput may be achieved. Since driving chains, drive belts, gear racks, gear wheels and driving shafts are not required, a relatively low-noise operation with low maintenance needs may be achieved.

According to some exemplary embodiments two or more moving units may be used. This allows to improve the holding and the positioning of the substrate and/or the throughput by an improved utilization of the track section.

According to some exemplary embodiments, the apparatus has a defined receiving position where the substrate is grasped by the holding unit and has a release or transfer position where the substrate is released or is transferred to a further manufacturing step.

According to some exemplary embodiments, the driving of the moving unit may base on the principle of a linear motor which is sometimes also referred to as a linear thrust unit or a linear servo motor. Suitable systems are offered, for example, by the company Beckhoff Automation GmbH.

According to some exemplary embodiments, the holding unit has an upper part and a lower part, wherein the upper part and the lower part can be displaced relative to one another. In order to hold the substrate, the substrate is inserted between the upper part and the lower part, and the upper part and the lower part are moved towards one another in order to hold the substrate via the holding unit. According to some exemplary embodiments, the holding unit acts like a pliers or a clamp which clamps the substrate. According to some exemplary embodiments, the upper and lower parts may comprise flat abutment faces in order to hold the substrate reliably without damaging it. It is possible that the upper part is fixed and the lower part is displaceable, that the lower part is fixed and the upper part is displaceable, or that the upper part as well as the lower part are displaceable.

If two or more track sections are used, according to an embodiment, the substrate is held by a moving unit on each of the track sections. As will be shown in the following, there are other exemplary embodiments where the substrate is held by two or more moving units on the same track section.

According to an exemplary embodiment the track section is configured to generate magnetic fields that vary over time along the longitudinal extension, and the moving unit comprises a permanent magnet.

This embodiment may allow that the moving unit does not require an additional power source for the movement. According to another exemplary embodiment the track section comprises a plurality of permanent magnets, and the moving unit is configured to generate magnetic fields that vary over time. This embodiment may allow that the track section can be implemented in a simple and cost-effective manner. Since the general working principle of linear motors is known to the skilled person, this concept will not be explained further. In the context of these embodiments it is pointed out that if a plurality of track sections and/or a plurality of moving units are used, the further track sections and/or the further moving units are configured in the same manner.

According to an exemplary embodiment the track section and the moving unit are configured so that the moving unit is guided during its movement.

This embodiment allows for a particularly precise movement of the moving unit. According to some exemplary embodiments, the moving unit comprises a support element having a support profile, wherein the support profile corresponds to a guide profile of a guide rail of the track section. It is pointed out that if a plurality of track sections and/or a plurality of moving units are used, the further track sections and/or the further moving units are configured in the same manner.

According to an exemplary embodiment the track section forms a closed loop.

This embodiment may allow that the moving unit may always be moved in the same direction. Since the closed loop has a forward track and a return track, there is no interference if one moving unit is to be moved from the end of the track section to the beginning of the track section. This embodiment also allows that a large number of moving units can be moved along the track section and can be returned to the beginning of the track section in a simple manner. In particular, it is possible to return the moving units at great speed from the end of the track section to the beginning of the track section. The closed loop may comprise a straight forward track and a straight return track which are connected at both sides by arc-like elements.

According to a further embodiment the apparatus comprises a control unit which is configured to control the movement and/or the position of the moving unit.

This embodiment allows, for example, to obtain a particular position for the moving unit and/or to obtain a particular speed for the moving unit which may, in particular, change along the track section. If a plurality of moving units is used, the moving units may be controlled individually or in groups. If a plurality of moving units is assigned to conveying a substrate, the control unit, according to an embodiment, controls the group of moving units such that the moving units move at equal speed. If a plurality of track sections is used, a first moving unit on a first track section and a second moving unit on a second track section may be moved in the same manner and at a constant distance.

According to a further embodiment the apparatus comprises, in addition to said first track section, a second rail-like track section having a longitudinal extension, and, in addition to said first moving unit, a second moving unit, which is configured to perform a movement relative to the second track section along the longitudinal extension of the second track section, wherein the second track section and the second moving unit are configured to interact such that the movement of the second moving unit is effected by magnetic interaction between the second track section and the second moving unit, and wherein the second moving unit comprises a holding unit which is configured to assume an opened and a closed state, wherein, in the opened state, a second section of the substrate can be inserted into the holding unit and, in the closed state, the second section is held by the holding unit.

This embodiment allows for a particularly precise guiding of the substrate. In this exemplary embodiment the substrate is held by the holding unit of the first moving unit as well as the holding unit of the second moving unit. In some exemplary embodiments, the track sections are arranged parallel to each other. This allows in a simple manner to avoid that lateral displacements occur during conveying. The first and the second track sections may have the same length and the same shape. Both moving units may be moved synchronously in order to avoid a yawing of the substrate.

According to a further embodiment, the distance between the first and the second track sections can be varied relative to each other.

This embodiment allows for a processing of substrates with varying widths, in principle even with arbitrary widths. It is possible that the first track section is moved towards a stationary second track section, that the second track section is moved towards a stationary first track section, or that the first and second track sections each are moveable. In order to be able to change the distance of the track sections relative to each other, at least one of the track sections, in some exemplary embodiments both track sections, is arranged on a holding system.

According to a further exemplary embodiment the apparatus comprises a third moving unit which is configured to perform a movement relative to the first track section along the longitudinal extension of the first track section, wherein the first track section and the third moving unit are configured to interact such that the movement of the third moving unit is effected by magnetic interaction between the first track section and the third moving unit, and wherein the third moving unit comprises a holding unit which is configured to assume an opened and a closed state, wherein, in the opened state, a third section of the substrate can be inserted into the holding unit and, in the closed state, the third section is held by the holding unit, and the apparatus comprises a fourth moving unit which is configured to perform a movement relative to the second track section along the longitudinal extension of the second track section, wherein the second track section and the fourth moving unit are configured to interact such that the movement of the fourth moving unit is effected by magnetic interaction between the second track section and the fourth moving unit, and wherein the fourth moving unit comprises a holding unit which is configured to assume an opened and a closed state, wherein, in the opened state, a fourth section of the substrate can be inserted into the holding unit and, in the closed state, the fourth section is held by the holding unit.

This embodiment allows to clamp the substrate at four locations and to thus obtain a good guiding.

In an exemplary embodiment the apparatus comprises a control unit that is configured to control the holding units such that the holding units of the first and second moving units open at a first point in time for releasing or transferring the substrate and that the holding units of the third and fourth moving units open at a later second point in time for releasing or transferring the substrate.

This embodiment allows to guide a substrate using all four moving units until the leading end of the substrate reaches the end of the conveying track of the apparatus. At this point in time the holding units of the first and second moving units open. The leading end of the substrate is released and can be provided to a further conveying track or a processing station. Since the substrate is still held by the third and fourth moving unit, the third and fourth moving units continue to push the substrate into the direction of the further conveying track or processing station.

In a further exemplary embodiment the apparatus comprises a control unit which is configured to control the first and second moving units for a first speed of the movement and to control the third and/or fourth moving unit for a second speed of the movement, wherein the second speed is less than the first speed.

This embodiment allows to tension the substrate between first/second moving units and third/fourth moving units. Since the first and second moving units have the tendency to run away from the third and/or fourth moving units, a tension is applied to the substrate, because the four moving units are holding on to the same substrate. The second speed may be set to a percentage of the first speed, wherein the percentage lies between 0% and less than 100%. According to an embodiment the speed of the third and fourth moving units is set to zero, so that the third and fourth moving units are pulled by the first and second moving units, because they are connected with the first and second moving units via the substrate. The percentage of the second speed relative to first speed is selected in particular in view of the possibility of tearing the substrate and the holding force of the holding units.

According to a further exemplary embodiment the holding units of the first and second moving units are set such that they provide a first holding force, and the holding units of the third and fourth moving units are set that they provide a second holding force, wherein the first holding force is greater than the second holding force.

This embodiment allows to prevent a tearing of the substrate. Via the first and second moving units it is ensured that the substrate is held precisely and can be precisely conveyed. The second holding force is selected such that the substrate will get loose from the holding units of the third and fourth moving units before it tears. The value of the second holding force can be determined via calculation, simulation or real-life experiments.

According to a second aspect the object is achieved by a system for printing on a substrate with an apparatus described above and a printing station, wherein the apparatus and the printing station are arranged relative to each other such that the apparatus can pass a substrate held in the holding unit by the printing station.

This embodiment allows to fulfill the challenging requirements that are present if a substrate is to be printed on which passes by a printing station. In particular, a constant movement along the longitudinal extension without any lateral displacement is desired. Further a constant distance to the printing station, in particular to the printing heads, shall be provided. These characteristics are provided by the apparatus described above, so that an improved system for printing on a substrate may be provided.

According to an exemplary embodiment a drying station trails the system when viewed in the direction of production, where the printed on substrate is dried. According to some exemplary embodiments, the substrate is transferred at the end of the track section to a conveying track of the drying station.

According to a third aspect the object is achieved by using a previously described apparatus to move a substrate past a processing station, in particular past a printing station for printing on the substrate.

It is also possible to use the apparatus for other applications that require a precise guiding of the substrate, for example a processing via cutting or stamping.

BRIEF DESCRIPTION OF THE DRAWINGS

It is understood that the features explained above and in the following cannot only be used in the specific combination, but may as well be used in other combinations or in isolation without leaving the scope of the present disclosure.

Exemplary embodiments of the disclosure are shown in the drawings and are explained in more detail in the following description. The figures show.

DESCRIPTION OF EXEMPLARY EMBODIMENTS

Figure 1:
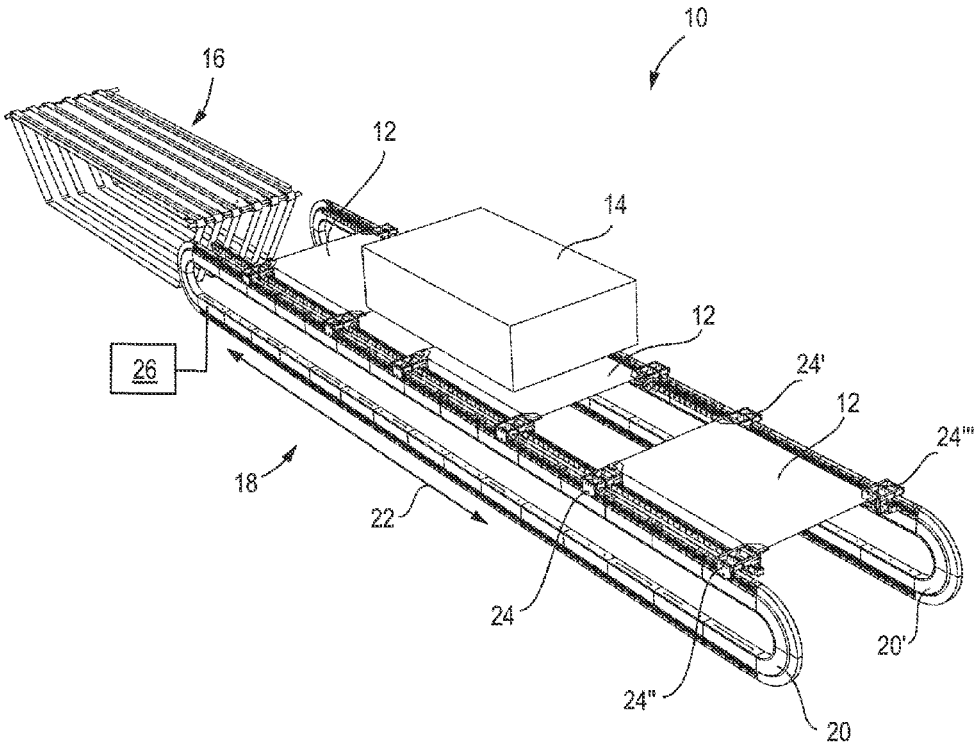
FIG. 1 shows a first embodiment of a system for printing on a substrate with a first embodiment of an apparatus for conveying a substrate.

FIG. 1 shows a first embodiment of a system 10 for printing on a substrate 12 having a printing station 14, shown symbolically, a drying station 16, only the drying conveyor is shown, and an apparatus 18 for conveying the substrate 12.

The apparatus 18 for conveying the substrate 12 comprises a rail-like track section 20, here a first track section 20 and a second track section 20', each having a longitudinal extension 22.

The apparatus 18 further comprises a moving unit 24, here a first moving unit 24, a second moving unit 24', a third moving unit 24" and a fourth moving unit 24'. Each moving unit 24 is configured to perform a movement relative to the track section 20 along the longitudinal extension 22 of the track section 20. The track section 20 and the moving unit 24 are configured to interact such that the movement of the moving unit 24 is effected based on a magnetic interaction between the track section 20 and the moving unit 24. Specifically, the first moving unit 24 and the third moving unit 24" interact with the first track section 20, and the second moving unit 24' and the fourth moving unit 24' interact with the second track section 20'.

The track section 20 is configured to generate magnetic fields that vary over time along the longitudinal extension 22. The track section 20 forms a closed loop. These statements apply correspondingly to the second track section 20'. The apparatus 18 comprises a control unit 26 which is configured to control the movement and/or the position of the moving unit 24. In this embodiment the control unit 26 controls the movement of all moving units 24 on the track sections 20.

Figure 2:
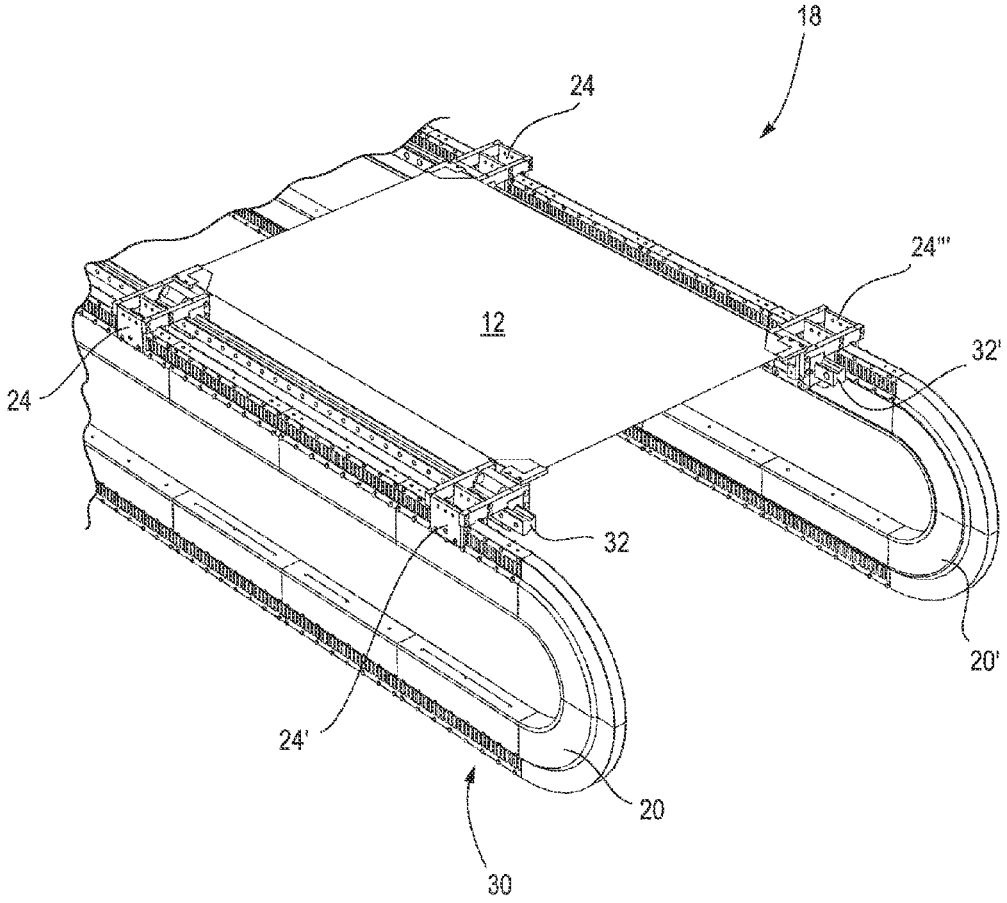
FIG. 2 shows a sectional enlargement of the front part of the system according to FIG. 1.

FIG. 2 shows an enlargement of the front part of the apparatus 18 according to FIG. 1. All previously introduced reference numerals continue to apply here and in the following.

As shown in FIG. 2, the track sections 20, 20' comprise coil arrangements 30 which generate said magnetic fields along the longitudinal extension 22 which can change over time. Further, guide rails 32, 32' having a guide profile are shown which guide the moving units 24, 24', 24", 24'" during their movement.

Figure 3:
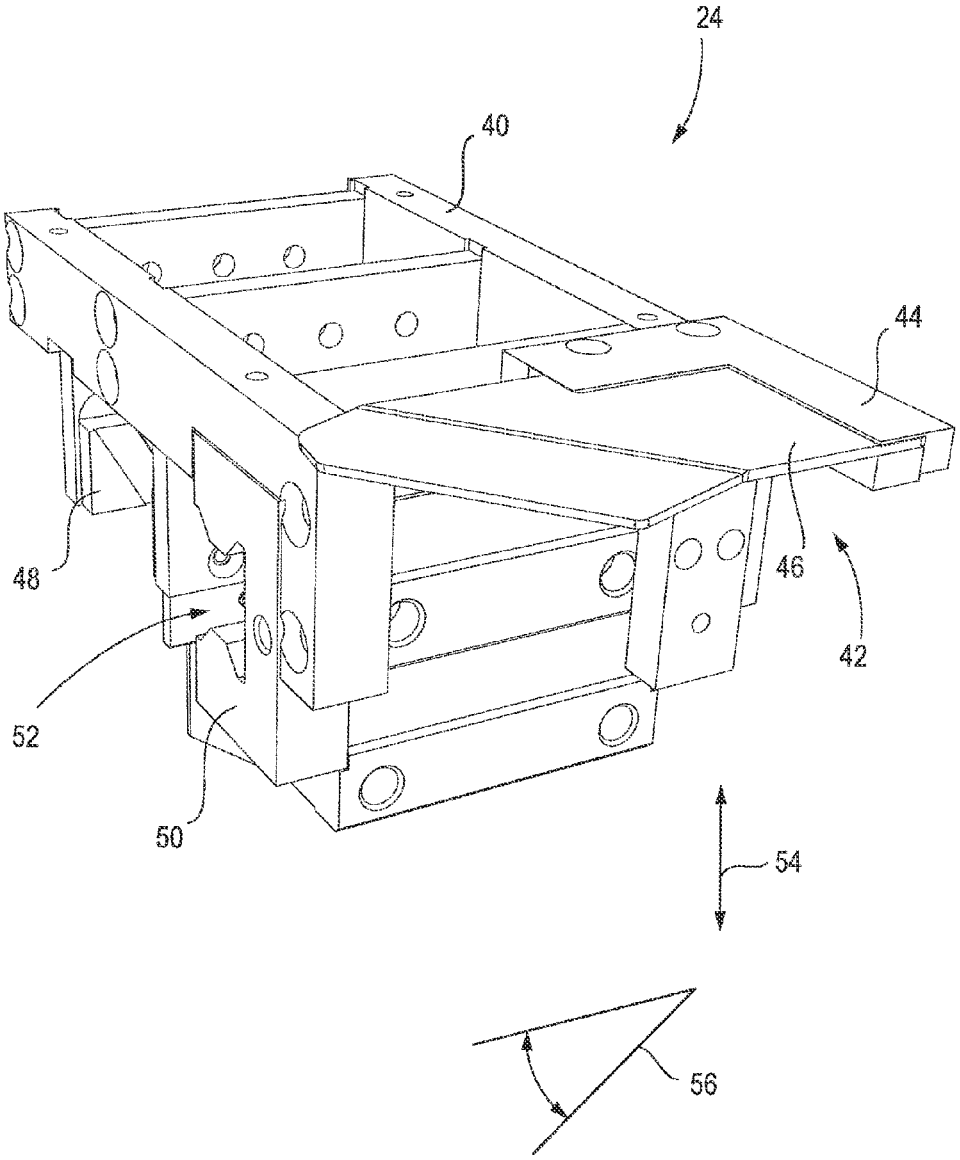
FIG. 3 shows a first embodiment of a moving unit.

FIG. 3 shows a first embodiment of a moving unit 24 according to FIG. 1. The moving unit 24 comprises a base body 40, a holding unit 42 having an upper part 44 and a lower part 46, one or more permanent magnets 48 and a support element 50 having a support profile 52 which, in particular, can be considered as the negative/inverse of the guide profile.

The holding unit 42 is configured to assume an opened state and a closed state. This is achieved by a relative displacement of the upper part 44 and the lower part 46 relative each other, according to some exemplary embodiments by a sliding 54 and/or a pivoting 56 of the lower part 46 relative to the upper part 44. In the opened state a section of the substrate 12 can be inserted into the holding unit 42, and in the closed state the section is held by the holding unit 42.

Figure 4:
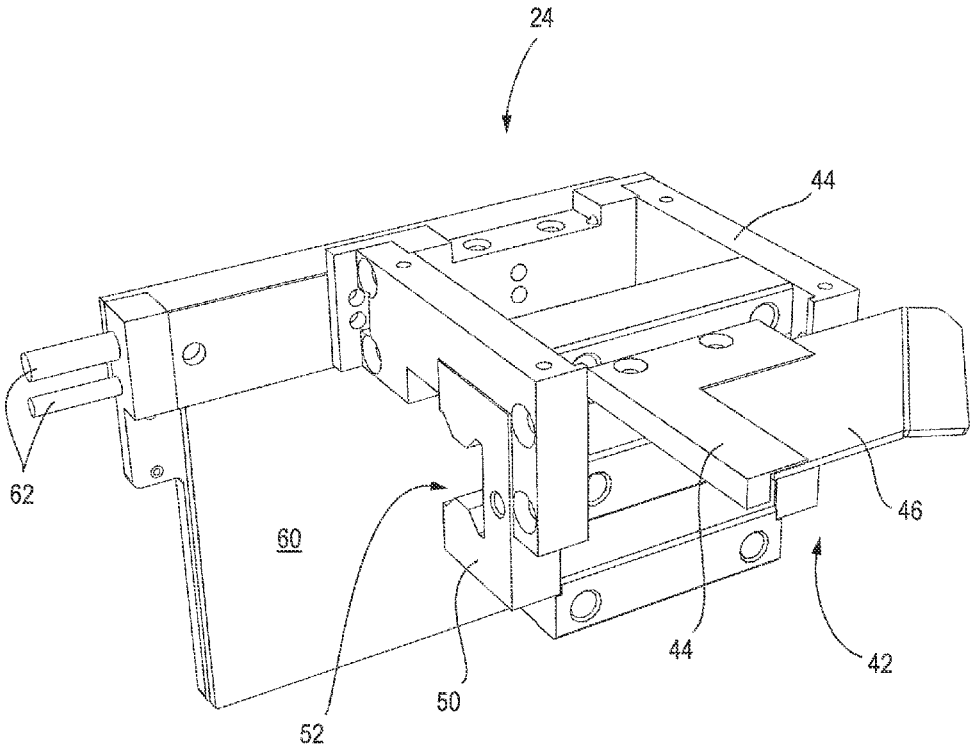
FIG. 4 shows a second embodiment of a moving unit.

FIG. 4 shows an alternative embodiment of the moving unit 24 for a further embodiment of the apparatus 18, not shown. The statements made in the context of FIG. 3 apply correspondingly.

However, for this embodiment the moving unit 24 does not comprise permanent magnets 48, but comprises a coil arrangement 60 which powered by a supply cable 62. A corresponding embodiment of a track section 20, not shown, comprises a plurality of permanent magnets, so that the previously described magnetic interaction is achieved again.

Figure 5:
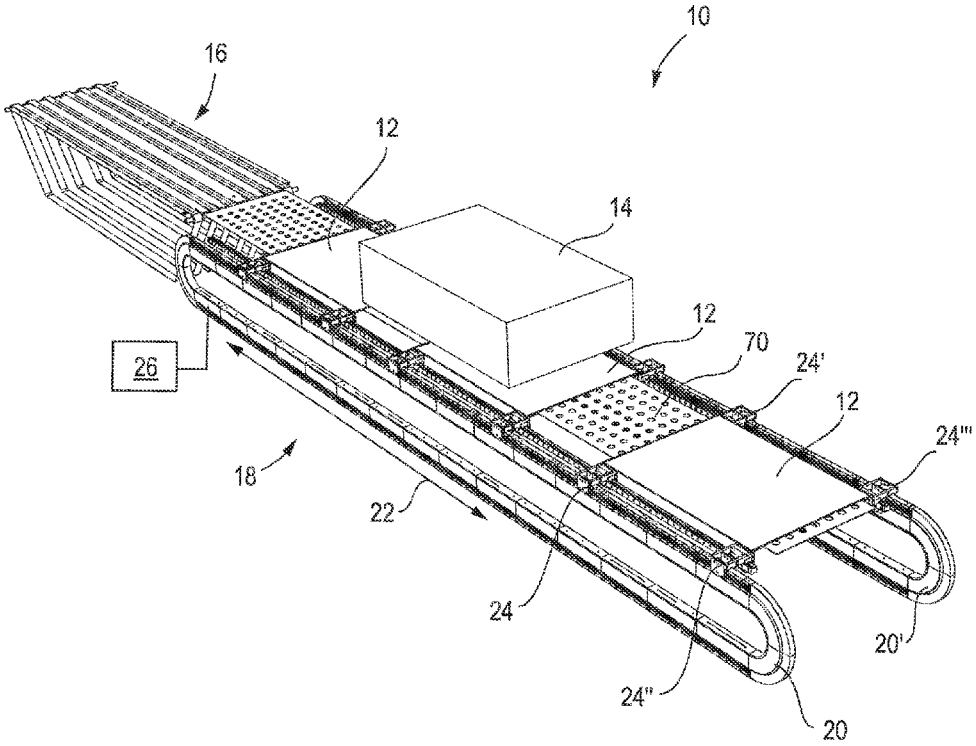
FIG. 5 shows a second embodiment of a system for printing on a substrate with a second embodiment of an apparatus for conveying a substrate.

FIG. 5 shows a second embodiment of a system 10 with a second embodiment of the apparatus 18. All statements in the context of FIG. 1 apply as well.

A particularity of this embodiment is that the apparatus 18 comprises a low-pressure rest 70, sometimes also referred to as a vacuum rest. When a substrate 12 glides over the low-pressure rest 70, it is pressed flat onto the low-pressure rest. Yet, it is still possible to pull the substrate 12 over the low-pressure rest 70 using the moving units 24, so that the substrate 12 can be moved precisely and with a constant distance under the printing station 14.

Figure 6:
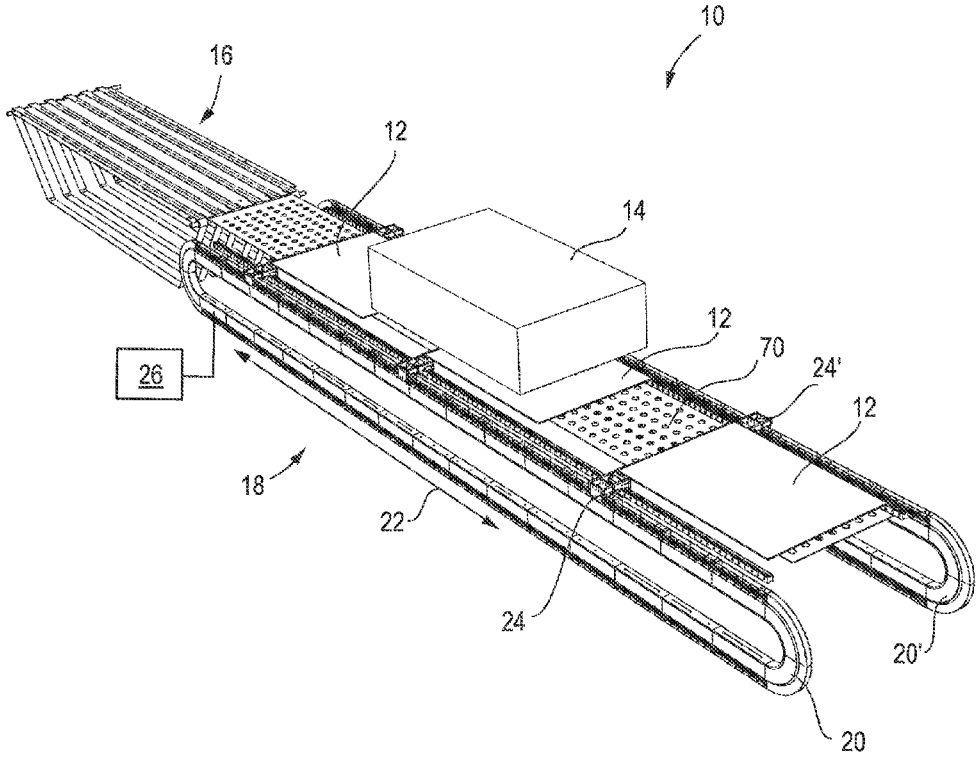
FIG. 6 shows a third embodiment of a system for printing on a substrate with a third embodiment of an apparatus for conveying a substrate.

FIG. 6 shows a third embodiment of a system 10 with a third embodiment of an apparatus 18. All statements made in the context of FIGS. 1 and 5 apply.

One particularity of this embodiment is that a substrate 12 is only conveyed by a first and a second moving unit 24'. Since the low-pressure rest 70 ensures that the substrate 12 is pressed onto the low-pressure rest 70, it is possible to omit the third and fourth moving units 24", 24'".

It is noted that the apparatus 18 comprises further moving units, however, these are not understood in the sense of a third and fourth moving units 24", 24'" since these do not hold on to the same substrate 12.

Figure 7:
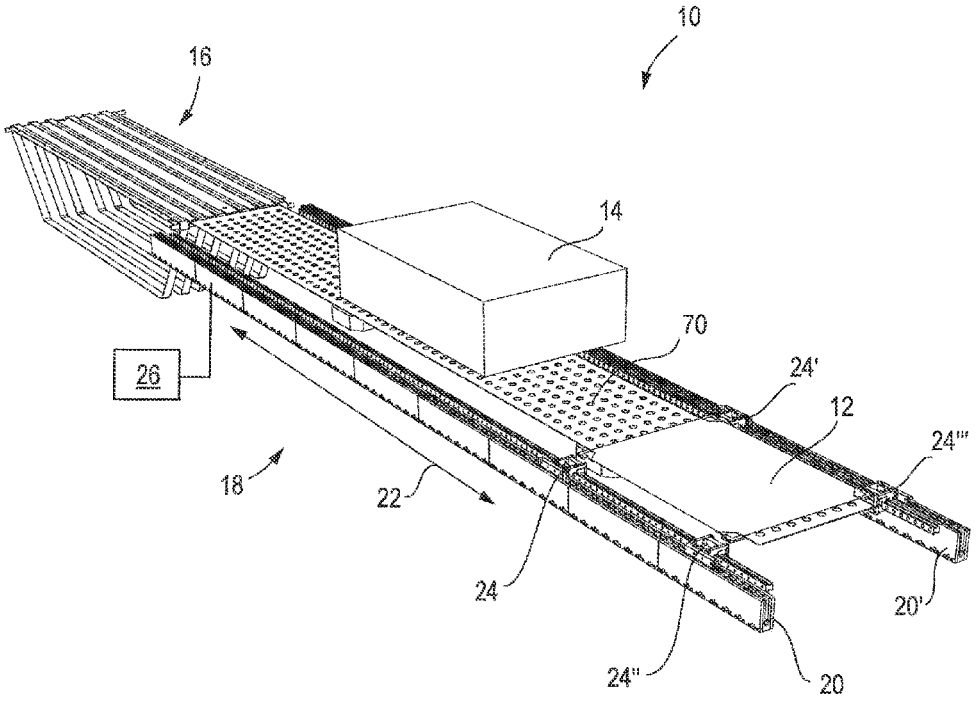
FIG. 7 shows a fourth embodiment of an apparatus for conveying a substrate.

FIG. 7 shows a simplified fourth embodiment of the apparatus 18. A track section 20 is used which does not provide a loop and can thus be easily implemented.

Figure 8:
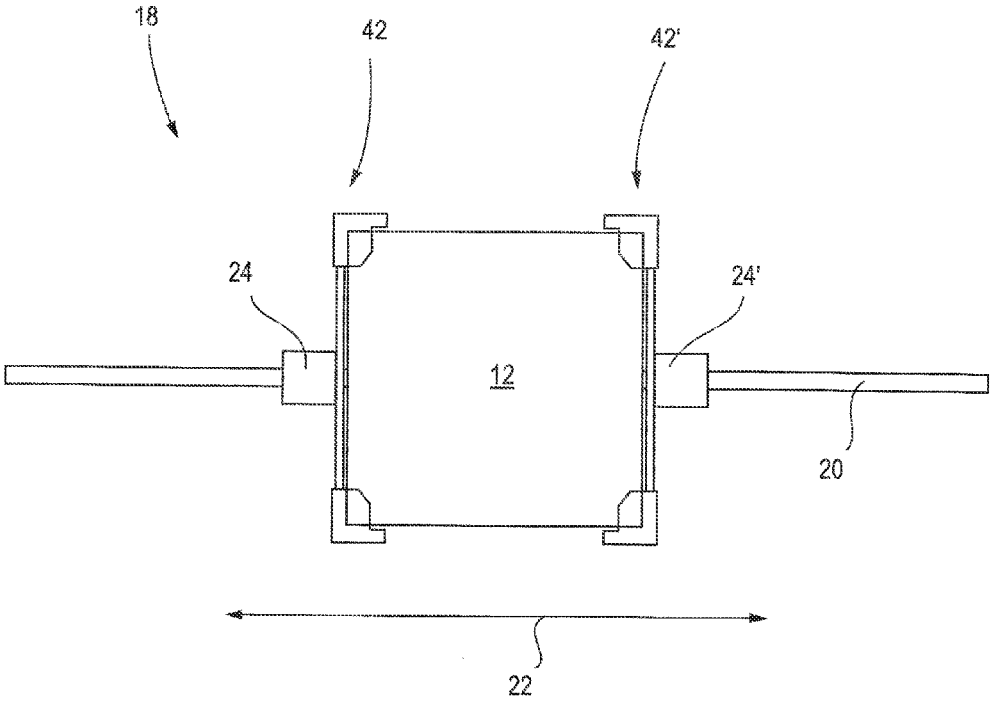
FIG. 8 shows a fifth embodiment of an apparatus for conveying a substrate.

FIG. 8 shows a particularly simple fifth embodiment of the apparatus 18 in a top view. Here, only one track section 20 is used on which the first moving unit 24 and a second moving unit 24' are moved. If the track sections are embodied as a closed loop, further moving units can be used. The moving units 24, 24' each comprise a holding unit 42, 42' which each hold on to two sections of the substrate 12.

The disclosed apparatus 18 for conveying a substrate 12 and the system 10 for printing on a substrate 12 may bring improvements for the processing of substrates 12 which do not have an inherent stability, in particular sheets of paper, plastic foils, textile materials or leather, etc. However, it is expressly pointed out that the apparatus 18 and the system 10 can also process substrates 12 which have an inherent stability.

Therefore, what we claim is:

1. An apparatus for conveying a substrate, wherein the apparatus comprises:

a rail-like first track section having a first longitudinal extension and a first moving unit, which is configured to perform a movement relative to the rail-like first track section along the first longitudinal extension of the first track section, wherein the rail-like first track section and the first moving unit are configured to interact such that the movement of the first moving unit is effected by magnetic interaction between the rail-like first track section and the first moving unit, and wherein the first moving unit comprises a first holding unit which is configured to assume an opened and a closed state, wherein, in the opened state, a first section of the substrate can be inserted into the first holding unit and, in the closed state, the rail-like first track section is held by the first holding unit; and a second rail-like track section having a second longitudinal extension and a second moving unit, which is configured to perform a movement relative to the second rail-like track section along the second longitudinal extension of the second rail-like track section, wherein the second rail-like track section and the second moving unit are configured to interact such that the movement of the second moving unit is effected by magnetic interaction between the second rail-like track section and the second moving unit, and wherein the second moving unit comprises a second holding unit which is configured to assume an opened and a closed state, wherein, in the opened state, a second section of the substrate can be inserted into the second holding unit and, in the closed state, the second section is held by the second holding unit, wherein the apparatus further comprises a low-pressure rest which is arranged relative to the first and second moving units such that the first and second moving units can pull the substrate over the low-pressure rest.

2. An apparatus for conveying a substrate, wherein the apparatus comprises:

a rail-like first track section having a first longitudinal extension and a first moving unit, which is configured to perform a movement relative to the rail-like first track section along the first longitudinal extension of the first track section, wherein the rail-like first track section and the first moving unit are configured to interact such that the movement of the first moving unit is effected by magnetic interaction between the rail-like first track section and the first moving unit, and wherein the first moving unit comprises a first holding unit which is configured to assume an opened and a closed state, wherein, in the opened state, a first section of the substrate can be inserted into the first holding unit and, in the closed state, the rail-like first track section is held by the first holding unit; and a second rail-like track section having a second longitudinal extension and a second moving unit, which is configured to perform a movement relative to the second rail-like track section along the second longitudinal extension of the second rail-like track section, wherein the second rail-like track section and the second moving unit are configured to interact such that the movement of the second moving unit is effected by magnetic interaction between the second rail-like track section and the second moving unit, and wherein the second moving unit comprises a second holding unit which is configured to assume an opened and a closed state, wherein, in the opened state, a second section of the substrate can be inserted into the second holding unit and, in the closed state, the second section is held by the second holding unit, wherein the first and second holding units of the first and second moving units are set such that they provide a first holding force, and the third and fourth holding units of the third and fourth moving units are set such that they provide a second holding force, wherein the first holding force is greater than the second holding force.

* * * * *